United States Patent [19]

Carroll

[11] Patent Number: 4,938,366

[45] Date of Patent: Jul. 3, 1990

[54] DISPLAY UNIT

[75] Inventor: Francis A. Carroll, Dublin, Ireland

[73] Assignee: Eolas, Dublin, Ireland

[21] Appl. No.: 206,838

[22] Filed: Jun. 15, 1988

[30] Foreign Application Priority Data

Jun. 15, 1987 [IE] Ireland ..... 1574/87
May 9, 1988 [IE] Ireland ..... 1388/88

[51] Int. Cl.[5] ..... A47F 7/00

[52] U.S. Cl. ..... 211/55; 211/128; 211/94.5

[58] Field of Search ..... 211/55, 128, 94.5, 52, 211/59.4, 88, 186, 190, 162

[56] References Cited

U.S. PATENT DOCUMENTS

| | | | |
|---|---|---|---|
| 1,465,891 | 8/1923 | Breuninger | 211/55 |
| 1,604,509 | 10/1926 | Caldwell | 211/128 |
| 1,672,633 | 6/1928 | Vogel | 211/55 |
| 3,198,340 | 8/1965 | Tokash | 211/55 X |

FOREIGN PATENT DOCUMENTS

| | | |
|---|---|---|
| 670065 | 4/1952 | United Kingdom . |
| 886952 | 1/1962 | United Kingdom . |
| 1273306 | 5/1972 | United Kingdom . |
| 1352008 | 5/1974 | United Kingdom . |
| 1391992 | 4/1975 | United Kingdom . |
| 1482997 | 8/1977 | United Kingdom . |
| 1505156 | 3/1978 | United Kingdom . |
| 1558540 | 1/1980 | United Kingdom . |
| 2034579 | 6/1980 | United Kingdom . |
| 2091539 | 1/1981 | United Kingdom . |
| 1600003 | 10/1981 | United Kingdom . |
| 2122479 | 1/1984 | United Kingdom . |
| 249311 | 3/1986 | United Kingdom . |

*Primary Examiner*—Alvin C. Chin-Shue
*Assistant Examiner*—Sarah A. Lechok
*Attorney, Agent, or Firm*—Bernard, Rothwell & Brown

[57] ABSTRACT

A display unit for articles comprises a plurality of elongate channels 3 suspended one from the other. Each of the channels 3 is of generally J-shaped cross-section for supporting the articles in the troughs thereby formed. Each longer arm of the J-shaped channel has a hook 3*a* which is engageable with the shorter arm of a J-shaped channel above. On the uppermost channel 3, the hook 3*a* is engageable with a bracket 2*a* or other support on a display surface 1 so as to provide a suspended tiered display. Struts in the form of sockets fixed to the rear of the channels 3 and rods 4 engaged in the sockets act as supports for the channels 3 against the mounting surface 1.

21 Claims, 7 Drawing Sheets

DISPLAY UNIT

The present invention relates to display units for use in retail outlets, banks, travel agencies and the like. In particular, the invention relates to display units for flat articles or flat-packaged articles, for example post cards or greeting cards, magazines or brochures, audio and video cassettes, hosiery and records.

Many different display units for flat or flat-packaged articles are already known. A user wishing to display such items in a particular display area, such as sitting on a particular counter-top or located by a particular wall, generally purchases a display unit appropriate to the particular display area, that is a display unit of appropriate size and capable of being supported in the appropriate manner.

A number of disadvantages are apparent. Firstly, a range of different display units must be manufactured to meet the requirements of different display areas. Secondly, if the layout or arrangement of a display area is changed the user may have to purchase new display units appropriate to the new layout or arrangement as prior art display units are either glued, nailed or screwed together to form a fixed display unit. The user must then either store for future use or dispose of the existing display units.

It is an object of the present invention to overcome the aforementioned disadvantages.

The invention provides a display unit for articles comprising a plurality of elongate channels suspended one from the other, each of the channels being of generally J-shaped cross-section for supporting the articles in the troughs thereby formed, first support means for engaging the uppermost J-shaped channel with display support means provided on a mounting surface and second support means for engaging the shorter arm of a J-shaped channel with the longer arm of a J-shaped channel below so as to provide a suspended tiered display.

In this way, no supporting structure is required underneath the display unit, thus allowing valuable floor space to be utilised.

Preferably, the first and second support means are provided on the longer arm of each J-shaped channel.

Advantageously, struts are provided on the longer arms of the J-shaped channels which struts extend rearwardly for contact with the mounting surface, so as to maintain the J-shaped channels at the desired angular relationship to the mounting surface.

Conveniently, each of the struts comprises a socket and a rod, the sockets being provided on the rear surfaces of the longer arms of the J-shaped channels, and the rods being engageable with the sockets.

Preferably, a sleeve is fitted over the end of the rod before said end in inserted into the socket, so as to provide an interference fit between the rod and the socket.

Preferably, also a plurality of ribs are provided on the outer surface of the sleeve and a plurality of flats are provided on the inner surface of the sleeve, the ribs and the flats being offset in relation to one another.

Advantageously, there are inserts locatable in the troughs of the J-shaped channels so as to divide the troughs into regions.

Conveniently, each insert includes a base, two side walls and an inclined front wall, thereby allowing each of a plurality of articles located within an insert to be tilted forward for inspection and also thereby preventing more than the optimum number of articles to be located within the insert.

Preferably, the first and second support means comprise at least one hook.

Preferably, the hook extends along the length of the longer arm of the J-shaped channel to form a lip and is integrally formed therewith.

The display unit of the invention may be manufactured from a transparent plastics material.

The invention will now be described more particularly with reference to the accompanying drawings which show, by way of example only, a number of embodiments according to the invention, and typical display units which may be assembled therefrom. In the drawings.

Figure 5:
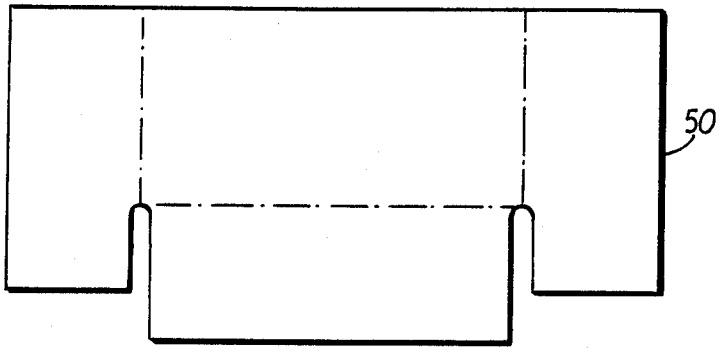
FIG. 5 is a surface development of a divider which is used in the troughs of the display unit as shown in FIG. 4.
Figure 5A:
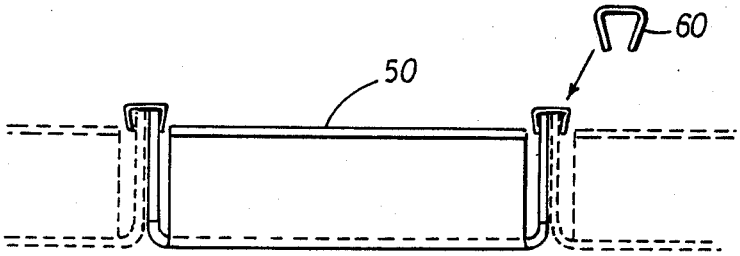
Figure 5B:
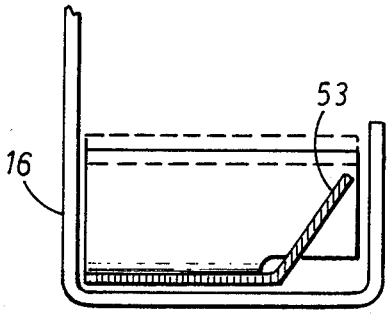
Figure 5C:
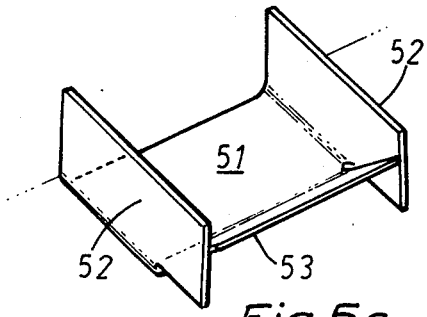
Figure 5D:
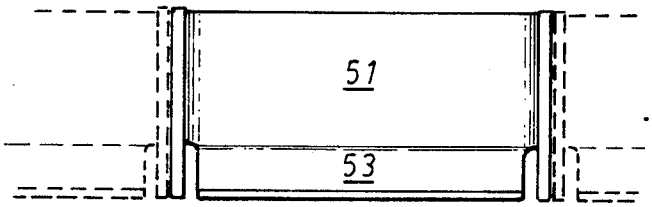
Figure 6:
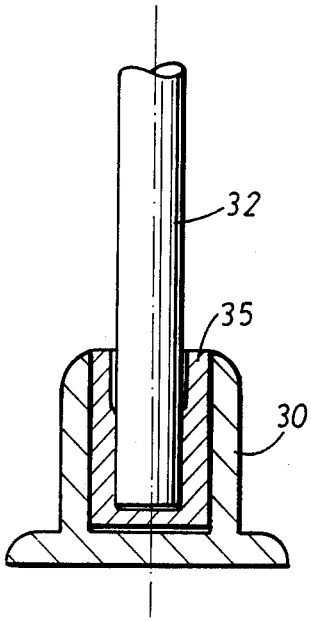
Figure 6A:
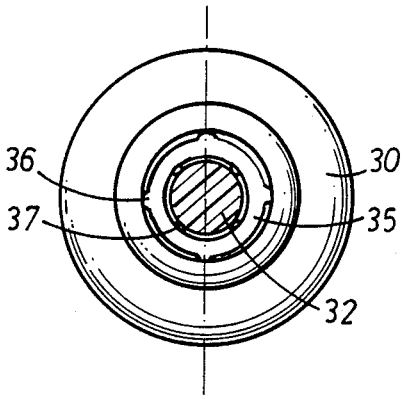
Figure 6B:
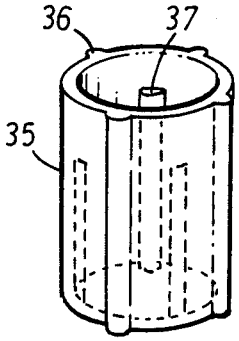
Figure 7:
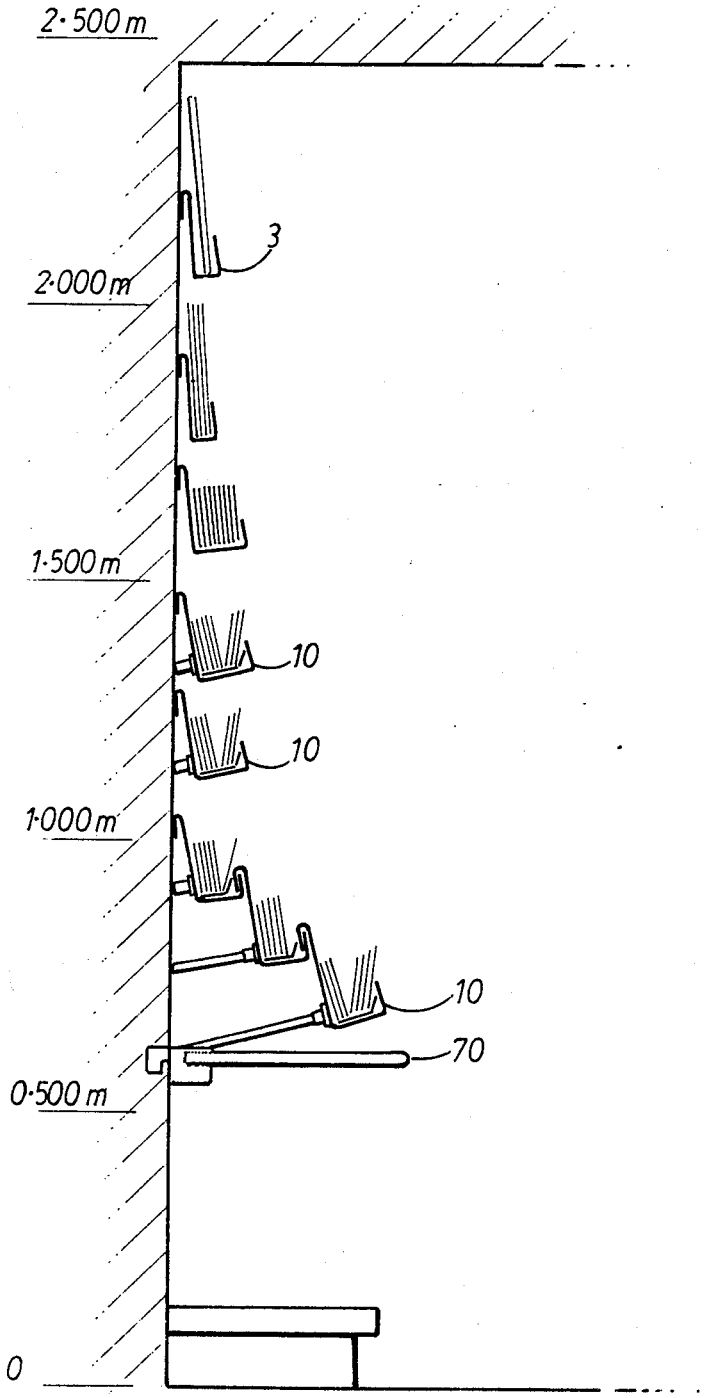
Figure 8:
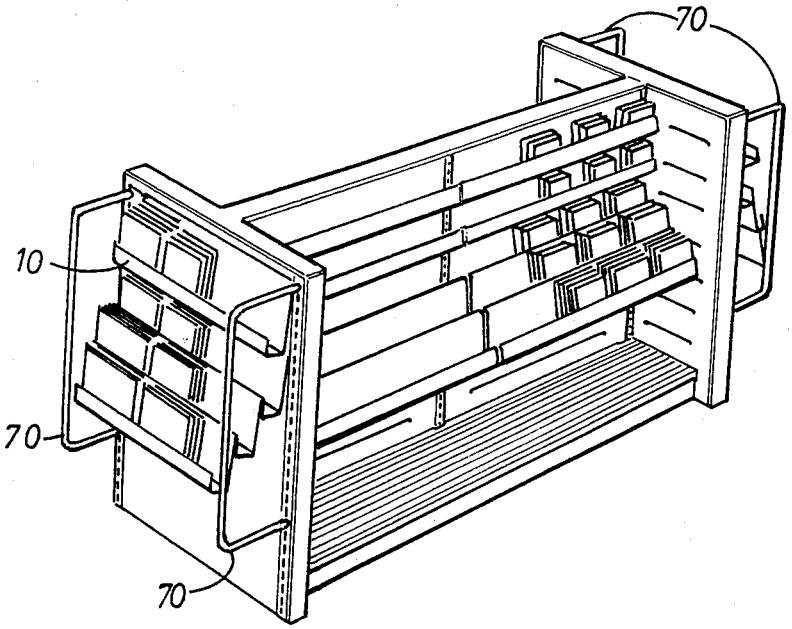

FIG. 5*a* is a front view of the divider juxtaposed with the dividers which are shown in dotted view;

FIG. 5*b* is an end view of the divider in a trough;

FIG. 5*c* a perspective view of the divider;

FIG. 5*d* is a plan view of the divider juxtaposed with other dividers;

FIG. 6 is a cross-sectional view through the rod, sleeve and socket used to support the display unit;

FIG. 6*a* is a plan view of the support elements;

FIG. 6*b* is a perspective view of the sleeve;

FIG. 7 is a view of a typical arrangement of a display using different sized troughs;

FIG. 8 is a perspective view of a gondola with display units according to the invention mounted thereon.

Figure 1:
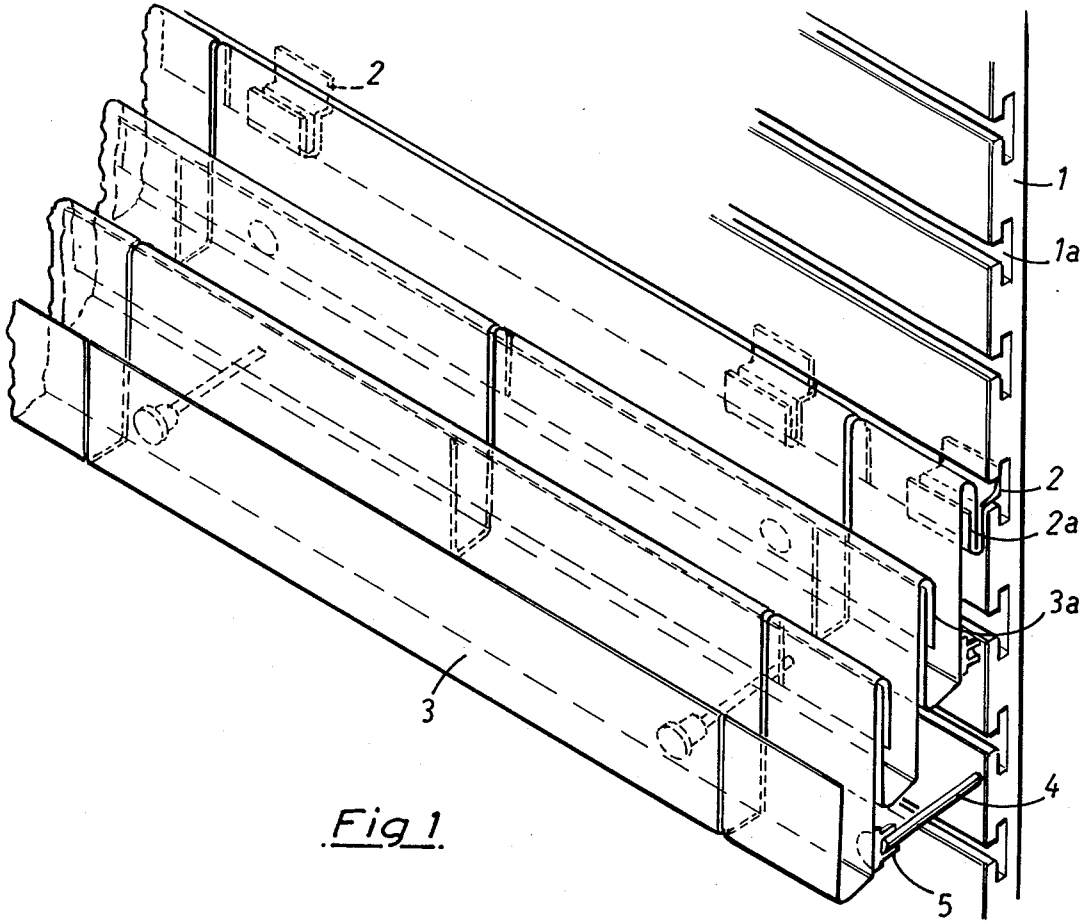
FIG. 1 is a perspective view of a wall mounted unit.

Referring initially to FIG. 1, the unit comprises a wall mounted backing plate 1, brackets 2, channel section members 3, and rods 4.

The unit is assembled as follows. Firstly the backing plate 1 is affixed to the wall. Then the brackets 2 are inserted into the slots or channels 1*a* which extend along the length of the backing plate 1. Next the first channel section member 3 is supported on the brackets 2, by co-operation of the upwardly extending front portions 2*a* of the brackets 2 with the hook 3*a* of the channel section member 3 thereby defining first support means. Then the second channel section member 3 is supported on the first in like manner, and the third is supported on the second thereby defining second support means. Rods 4 are positioned between the channel section member 3 and the backing plate 1, so as to space these apart from one another, so as to support the channel section members, and so as to set the angle or tilt of the individual channel section members and thus of the display unit as a whole, the angle being variable between the vertical and 20° to the vertical. The rods 4 are press fitted into a socket 5 permanently fixed to the outside face of the channel section members 3. Different lengths of rod are used for the different rows of channel section members.

A display unit of any desired height may be assembled by attaching a sufficient number of channel section member 3, one parallel to and supported by the next.

The limit to the height is set only by the weight of the material to be supported. The display unit shown in FIG. 1 comprises three channel section members in parallel.

A display unit of any desired length may also be assembled. This is done by placing a sufficient number of channel section members end to end in a first row of such members, then attaching a second row to the first and so on, but placing the channel section members in the second row in a position which is offset lengthwise relative to those in the first row, so that the channel section members of the second row straddle the gaps between those of the first row, and so on. Thus the channel section members of the different rows have the same offset position or relationship to one another, as bricks in different courses of a brick wall. For this purpose, channel section members of half length are manufactured which may be positioned at the end of a row. This offset arrangement is illustrated in FIG. 1.

Figure 2:
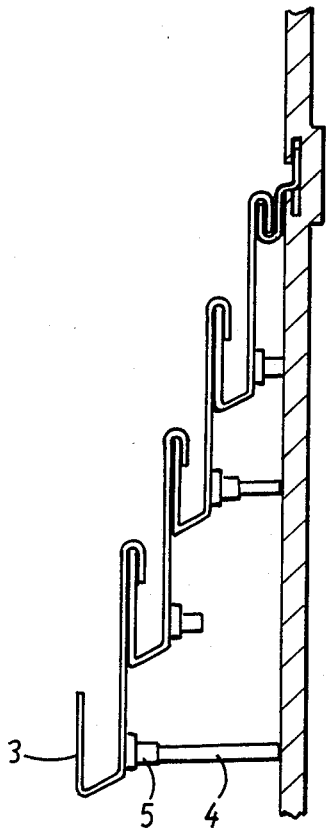
FIG. 2 is an end on view, on a smaller scale, of a unit similar to that shown in FIG. 1.

Referring now to FIG. 2, there is shown a display unit similar to that shown in FIG. 1, but with a difference that it comprises four rows of channel section members instead of three, and that the second and fourth channel section members are supported by rods instead of only the third.

Figure 3:
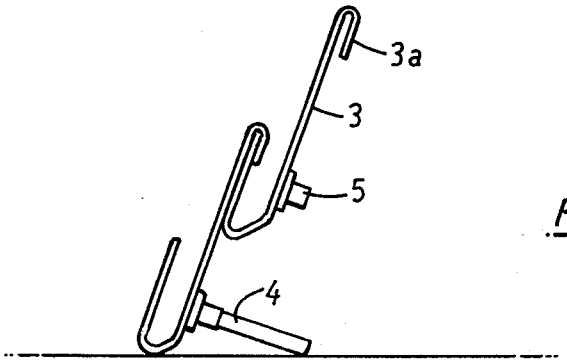
FIG. 3 is an end-on view of a free standing unit.

Referring now to FIG. 3, the free standing unit again comprises channel section members 3. In this case, however, the lower channel section member 3 is supported to the generally upright orientation by means of a rod 4, and the next channel section member 3 is supported by the lower most one by being attached thereto by a fixing means, such as studs or buttons.

Figure 4:
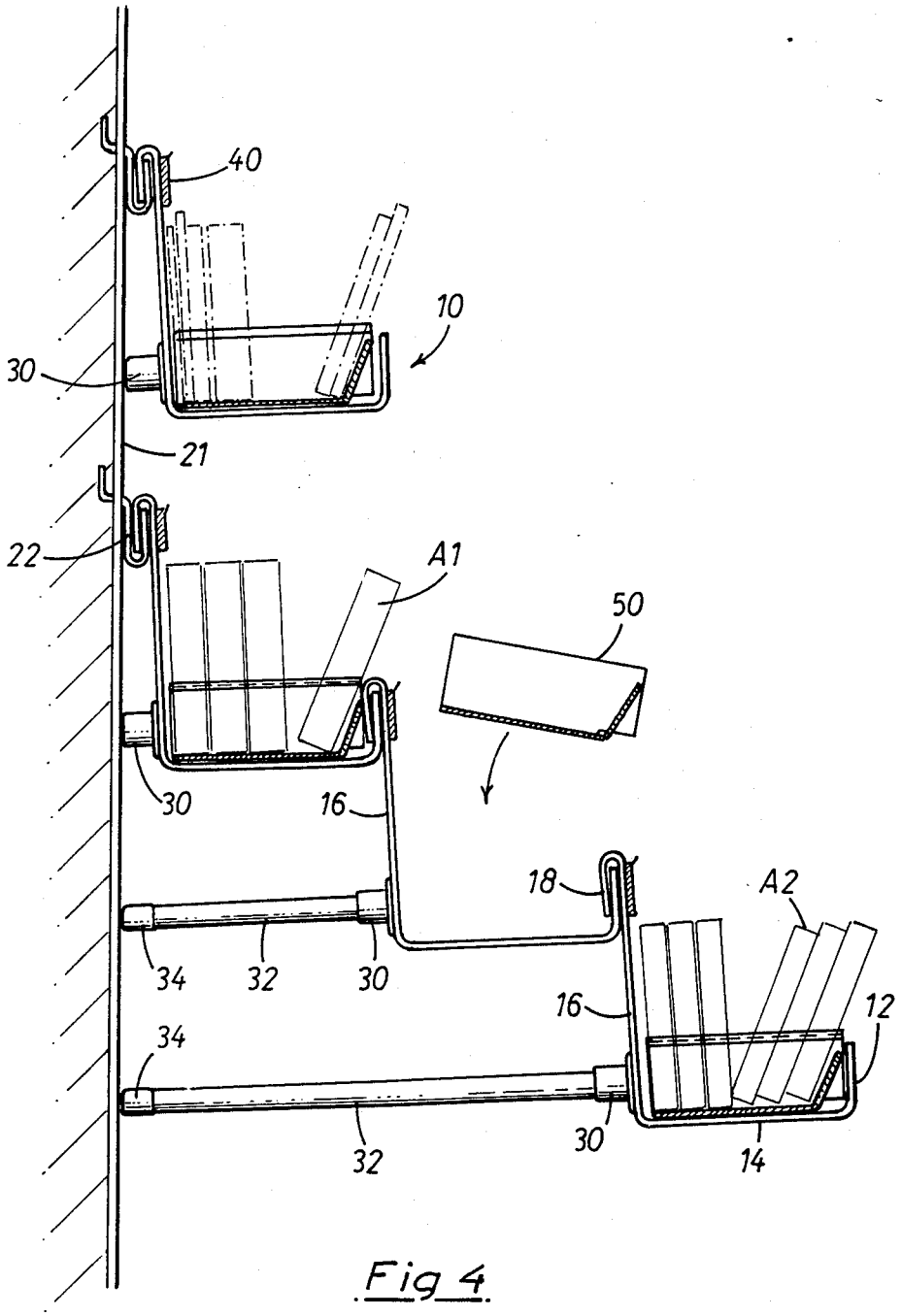
FIG. 4 is a side view of a display unit according to the invention, the channel sections or troughs of the unit being sized to accommodate audio cassettes and/or compact discs.

Referring now to FIG. 4, the display unit shown comprises four channel members 10 having the same cross-section. A channel member 10 which can be of 1 m in length, 1.2 m, or cut to suit the particular requirement, has a short front wall 12, a base or bottom wall 14, a high back wall 16. The top edge of the back wall 16 is turned over to form a hook 18. Each hook 18 may engage with a front wall 12 of another channel member or a bracket 22 which is mounted on a wall mounted backing plate 21. At the rear of each back wall 16 is a socket 30 which either rests against the backing plates or engages with one end of a rod 32. The other end of each rod 32 is provided with a cap 34 which contacts the backing plate 21. The rod 32 and socket 30 provides a support for each channel member 10.

A ticket strip 40 is applied to the front face of the upper end of back wall 16 so as to indicate what product is being sold in each trough 10.

The channel members 10 shown in FIG. 4 are in a single tier and a treble tier. However, the number of tiers may be of any required number, it just being necessary to have rods 32 of sufficient length.

Located in each channel member 10 are juxtaposed dividers 50. Referring now to FIGS. 5 to 5*d*, each divider 50 comprises a base 51, two side walls 52 and a sloping front wall 53. The function of the divider is twofold, firstly it allows a customer to browse through the items A in each trough 10, and secondly it prevents the trough 10 from being overloaded with item A which would prevent browsing. The dividers 50 are juxtaposed in each channel member 10 and an elongate channel section 60 is used to connect adjoining side walls 52.

Details of the socket and rod support system 30, 32 are shown in FIGS. 6 to 6*c*. In the particular embodiment shown, the socket 30 is an injection moulded acrylic item and the rod 32 is extruded acrylic. The dimensions of the rod 32 vary within a large tolerance and thus make it difficult to achieve a good interference fit. To overcome this problem, the inner diameter of the socket 30 is larger than the outer diameter of the rod 32, a sleeve 35 is located over the end of the rod 32 and then the rod 32 and sleeve 35 are inserted into the socket 30. The sleeve 35 is manufactured from a soft polyethylene and is provided with four ribs 36 on the outer circumference of the sleeve 35. The ribs 36 are tapered so that as the sleeve 35 is pushed into the socket 30, the interference fit between the two is increased. Located within the sleeve 35 and commencing approximately one quarter of the distance from the mouth of the sleeve are four inner ribs or flats 37. The four flats 37 are offset in relation to the ribs 36. The design of the sleeve 35 and the soft material means that a good fit is achieved either with a slightly large diameter rod 32 or a slightly small diameter rod 32.

FIGS. 7, 8 and 8*a* illustrate how the display units according to the invention may be used to provide attractive displays at waist level, eye level and higher. Crash bars 70 are provided so as to protect the display.

The embodiment of channel member 10 shown in FIG. 4 can accommodate four audio tape cassettes A1 or six compact disc cassettes A2. In another embodiment of channel member not shown, the channel member 10 can accommodate five audio tape cassettes, eight compact disc cassettes, or standard paperback books, with the front cover facing out or the book edge facing out.

The dimensions of the channel members 10 and dividers 50 may of course be made to suit whatever product is being sold. The channel members 10 are manufactured in line bent transparent acrylic sheet. They can also be manufactured in an extruded plastics material or aluminium and/or pressed metal.

The mounting plate may be dispensed with by providing the brackets with screw holes to enable them to be fixed directly to a wall.

The display units of the invention are easy to manufacture and may be readily assembled and re-assembled by a user as required.

By manufacturing the display units in a transparent material, then the articles on display are completely visible and the display unit itself does not detract from the overall display of the articles.

I claim:

1. A display unit for articles comprising a plurality of elongate channels suspended one from the other, each of the channels being of generally J-shaped cross-section defining a high rear wall, a low front wall, and a bottom wall to form a trough for supporting the articles;

first support means for supporting the high rear wall of the uppermost J-shaped channel on a mounting surface; and second support means for supporting the high rear wall of each lower J-shaped channel on the low front wall of a higher J-shaped channel so as to provide a suspended tiered display.

2. A display unit as claimed in claim 1, in which the first and second support means are provided on the higher rear wall of each J-shaped channel.

3. A display unit as claimed in either claim 1 or claim 2, in which the first and second support means comprise at least one hook.

4. A display unit as claimed in claim 3 in which each hook extends along the length of the high rear wall of the J-shaped channel to form a rearward and downward extending lip and is integrally formed therewith.

5. A display unit as claimed in claim 1, in which struts are provided on the high rear wall of one or more J-shaped channels, said struts extending rearwardly for contact with the mounting surface, so as to maintain the J-shaped channels at the desired angular relationship to the mounting surface.

6. A display unit as claimed in claim 5, in which each of the struts comprises a socket and a rod, the sockets being provided on the rear surfaces of the high rear walls of the J-shaped channels, and the rods being engageable with the sockets.

7. A display unit as claimed in claim 6, in which a sleeve is fitted over the end of the rod before said end is inserted in the socket, so as to provide an interference fit between the rod and the socket.

8. A display unit as claimed in claim 7, in which a plurality of ribs are provided on the outer surface of the sleeve and a plurality of flats are provided on the inner surface of the sleeve, the ribs and the flats being offset in relation to one another.

9. A display unit as claimed in claim 1, including inserts locatable in the troughs of the J-shaped channels so as to divide the troughs into regions.

10. A display unit as claimed in claim 9, in which each insert includes a base, two side walls and an inclined front wall, thereby allowing each of a plurality of articles located within an insert to be tilted forward for inspection and also thereby preventing more than the optimum number of articles to be located within the insert.

11. A display unit as claimed in claim 1, in which the J-shaped channels are manufactured from a transparent, plastics material.

12. A display unit for articles comprising a plurality of elongate channels, each channel being of generally J-shaped cross-section defining a high rear wall, a low front wall, and a bottom wall to form a trough for supporting the articles;

first support means for supporting the high rear wall of the uppermost J-shaped channel on a mounting surface;

second support means for supporting the high rear wall of each lower J-shaped channel on the low front wall of the next higher J-shaped channel so as to provide a suspended tiered display; and a plurality of struts for engaging between the rear surface of one or more high rear walls of the channels and the mounting surface so as to maintain the J-shaped channels at the desired angular relationship to the mounting surface.

13. A display unit as claimed in claim 12, in which the first and second support means are provided on the higher rear wall of each J-shaped channel.

14. A display unit as claimed in either claim 12 or 13, in which the first and second support means comprise at least one hook.

15. A display unit as claimed in claim 14 in which each hook extends along the length of the higher rear wall of the J-shaped channel to form a rearward and downward extending lip and is integrally formed therewith.

16. A display unit as claimed in claim 15, in which each of the struts comprises a socket and a rod, the sockets being provided on the rear surfaces of the high rear walls of the J-shaped channels, and the rods being engageable with the sockets.

17. A display unit as claimed in claim 16, in which a sleeve is fitted over the end of the rod before said end is inserted in the socket, so as to provide an interference fit between the rod and the socket.

18. A display unit as claimed in claim 17, in which a plurality of ribs are provided on the outer surface of the sleeve and a plurality of flats are provided on the inner surface of the sleeve, the ribs and the flats being offset in relation to one another.

19. A display unit as claimed in claim 12 including inserts locatable in the troughs of the J-shaped channels so as to divide the troughs into regions.

20. A display unit as claimed in claim 19, in which each insert includes a base, two side walls and an inclined front wall, thereby allowing each of a plurality of articles located within an insert to be tilted forward for inspection and also thereby preventing more than the optimum number of articles to be located within the insert.

21. A display unit as claimed in claim 12, in which the J-shaped channels are manufactured from a transparent, plastics material.

* * * * *